US008387600B1

(12) United States Patent
Horn

(10) Patent No.: US 8,387,600 B1
(45) Date of Patent: Mar. 5, 2013

(54) ARCHERY BOW PRESS

(76) Inventor: Charles Edward Horn, Cedar Rapids, IA (US)

( * ) Notice: Subject to any disclaimer, the term of this patent is extended or adjusted under 35 U.S.C. 154(b) by 562 days.

(21) Appl. No.: 12/652,086

(22) Filed: Jan. 5, 2010

Related U.S. Application Data

(60) Provisional application No. 61/142,426, filed on Jan. 5, 2009.

(51) Int. Cl.
*F41B 5/14* (2006.01)

(52) U.S. Cl. ..... 124/1; 124/86; 124/88; 124/90

(58) Field of Classification Search ..... 124/1, 23.1, 124/86, 88, 90
See application file for complete search history.

(56) References Cited

U.S. PATENT DOCUMENTS

| | | | | |
|---|---|---|---|---|
| 5,222,473 | A * | 6/1993 | Lint | 124/86 |
| 5,370,103 | A * | 12/1994 | Desselle | 124/86 |
| 5,433,186 | A * | 7/1995 | Corwin | 124/86 |
| 5,640,944 | A * | 6/1997 | Minneman | 124/1 |
| 5,791,324 | A * | 8/1998 | Johnson | 124/25.6 |
| 5,983,879 | A * | 11/1999 | Gifford | 124/1 |
| 6,220,235 | B1 * | 4/2001 | Sands | 124/1 |
| 6,386,190 | B1 * | 5/2002 | Kurtz, Jr. | 124/1 |
| 6,932,070 | B1 * | 8/2005 | Kurtz, Jr. | 124/1 |
| 6,968,834 | B1 * | 11/2005 | Gibbs | 124/1 |
| 7,089,923 | B2 * | 8/2006 | Johnson | 124/1 |
| 7,185,644 | B2 * | 3/2007 | Kurtz, Jr. | 124/1 |
| 7,255,099 | B2 * | 8/2007 | Henry | 124/1 |
| 7,311,095 | B2 * | 12/2007 | Bauder et al. | 124/1 |
| 7,597,094 | B2 * | 10/2009 | Pittman | 124/1 |
| 7,644,708 | B2 * | 1/2010 | Pittman | 124/1 |
| 8,096,059 | B2 * | 1/2012 | Stagg | 33/506 |
| 8,176,906 | B2 * | 5/2012 | Simo et al. | 124/25.6 |
| 2006/0000462 | A1 * | 1/2006 | Kurtz | 124/1 |
| 2006/0191522 | A1 * | 8/2006 | Henry | 124/23.1 |
| 2007/0079818 | A1 * | 4/2007 | Bauder | 124/1 |
| 2007/0119438 | A1 * | 5/2007 | Pittman | 124/1 |
| 2009/0056688 | A1 * | 3/2009 | Marsh et al. | 124/1 |
| 2009/0071022 | A1 * | 3/2009 | Stagg | 33/265 |
| 2009/0107475 | A1 * | 4/2009 | Pittman | 124/86 |
| 2010/0089376 | A1 * | 4/2010 | Bunk et al. | 124/86 |
| 2011/0162631 | A1 * | 7/2011 | Tulpa | 124/86 |
| 2011/0232616 | A1 * | 9/2011 | Gouramanis | 124/1 |

OTHER PUBLICATIONS

C.S. Gibbs Corporation, Sure-Loc Archery Products, X-Press Instructions, C.S. Gibbs Corporation, Versailles, IN, United States.

* cited by examiner

*Primary Examiner* — Gene Kim
*Assistant Examiner* — Alexander Niconovich
(74) *Attorney, Agent, or Firm* — Allan L. Harris; Shuttleworth & Ingersoll, PLC

(57) ABSTRACT

An improved archery bow press used to relieve tension in the bow string of a compound archery bow so that maintenance and repair of the bow string and its components may be safely and easily accomplished. A threaded rod is mounted adjacent and parallel to an elongate beam allowing brackets slidable along the beam to be positioned at differing spacings therebetween. The threaded rod is turned by a crank perpendicularly extending from the threaded rod. Limb engaging arms are hinged to the slidable brackets. Link members are pivotably retained to the limb engaging arms and the link members are retainable to a telescoping part of a screw jack which is retained to the beam. At least one of the link members includes a pin support bracket along its length. The pin support bracket supports a tapered pin extending laterally from the pin support bracket over a bow placed in the bow press. While the bow is urging the limbs around their connections to the bow riser, the bow string may be passed over the pin after which the bow press may relax the limbs and provide tension on the bow string in a position deflected laterally from the plane of the bow riser.

21 Claims, 3 Drawing Sheets

ARCHERY BOW PRESS

CROSS-REFERENCE TO RELATED APPLICATIONS

The present application claims priority under 35 USC §119 to provisional application 61/142,426 filed Jan. 5, 2009, which is incorporated herein by reference.

BACKGROUND

A typical compound archery bow includes a pulley at one end and an eccentric cam at the appropriate end around which the cable of the bowstring is passed. The stringing or tuning of a twin cam bow, with its eccentrically mounted cam and its pulley, tension cable and bow string is critical to achieve a proper balance of the eccentrically mounted pulleys or cams. The complexity of the stringing and the sensitivity to proper tuning of the bow, makes it very difficult to string and tune a compound bow without the aid of a bow press.

Periodic retuning of compound bows is often required to maintain desired performance levels. For this and to change, replace or repair components of the compound bow, such as the bowstring, string sights, dampers, the tension cable, the cams and other components, a bow press is essentially required.

Through the years a number of bow presses have been developed for facilitating stringing and maintenance of compound bows. In general, these presses have included a stationary base having a pair of spaced apart inside surface supports, in the form of pegs or rollers, for contacting the inside of the bow, and a pair of limb supports, in the form of pegs or rollers, attached to a movable mechanism for applying a bending force to the limbs of the bow. Such a bow press is described in Gibbs, U.S. Pat. No. 6,968,824.

It is very important that the inside surface support and the limb supports of the bow press be precisely positioned in such a manner that the bow is properly loaded into the press in a manner that when the limbs are bent, the forces will not overstress or otherwise damage the bow. Because compound bows vary dimensionally, particularly in riser length, it is necessary that the inside surface support and the limb supports on the bow press be adjustable. In the past, it has been customary to provide incremental holes in the bow press so that the position of the inside surface support and the limb supports could be moved to achieve a satisfactory fit with regard to a given bow. The incremental nature of this adjustment approach often results in a fit of the bow press to the bow which is not quite ideal, and can result in damage to the bow. In the patent to Gibbs, U.S. Pat. No. 6,968,834, an improvement is made to allow manually adjustable sliding clamps which are selectively moveable along a beam and where located properly, may be clamped to the beam by tightening bolts or set screws.

Prior bow presses are not easy to adjust, in that the movable components are typically bolted to the bow press or clamped along a beam, thereby requiring the use of wrenches or special care for making necessary adjustments. A more expeditious and convenient adjustment apparatus is needed.

It is desirable, therefore, to provide an improved bow press apparatus and method which overcomes one or more of the problems described above, or other problems and shortcomings of prior bow presses.

SUMMARY OF THE INVENTION

The present invention provides an improved archery bow press used to relieve tension in the bow string of a compound archery bow so that maintenance and repair of the bow string and its components may be safely and easily accomplished.

The archery bow press provides a support base supporting an elongate beam oriented horizontally. An upright screw jack is located midway along the beam and is retained to the beam. An elongate threaded rod is mounted to the base adjacent and parallel to the elongate beam. The threaded rod is supported at each opposing end and the rod is also supported in a central bearing where the rod contains no threads. The first half of the rod is threaded with right hand threads and the second half of the rod is threaded with left hand threads. A pair of pivot arm bracket members is slidable along the beam with one bracket member on each opposing side of the midpoint of the beam. The pivot arm bracket members are coupled to the threads of the threaded rod such the rotation of the rod will cause the pivot arm bracket members to be drawn together or moved apart depending on the direction of rotation of the threaded rod. A gear box is mounted at one end of the threaded rod which provides a coupling for a crank handle such that the crank handle may have an axis perpendicular to the axis of the threaded rod. Limb supporting arms are hinged to each of the pivot arm bracket members and each limb support arm has a limb support bracket member slidable along its length. Each of the limb support bracket members is hinged to an elongate link member with each of the link members selectively and adjustably mounted to the screw jack which is retained to the midpoint of the beam. A laterally extending rod which is physically cushioned is retained to each pivot arm bracket such that a bow can be removably retained to each laterally extending rod by elastomeric bands with the bow suspended under the laterally extending rods. The pivot arm brackets are caused to move along the beam by use of the crank handle which rotates the elongate threaded rod, so that the pivot arm brackets can be placed below the connections of each of the bow limbs to the bow riser. Another set of cushioned retaining rods is mounted to each limb support bracket member such that each cushioned retaining rod may support the underside of a limb near its distal end. A pin support bracket is adjustably retained to each of the elongate link members by a clamping device. Each pin support bracket supports a horizontally projecting tapered pin having a generally conical shape and having an annular groove near the tip of the pin into which the bow string of the compound bow may be temporarily placed during repair and maintenance of the bow string.

In another use of the archery bow press, with the limbs of the bow urged toward each other to reduce tension on the bow string, a cable section of the bow string may be detached from the bow and attached to one of the tapered pins, whereupon the screw jack may be lowered to relieve deflection of the limbs relative to the riser. A flexible strap may be employed to temporarily connect a segment of the bow string to the bow riser in order to place tension on the bow string. With this application, the cable section attached to a pin may then be refurbished.

Because of the gear box permitting a crank to be used which extends perpendicularly from the axis of the threaded rod, a user need not move from a position near the riser of a bow in the bow press while adjusting the spacing of the pivot arm bracket members away from the opposing ends of the beam because when the spacing between the pivot arm brackets is being selected, it is to conform the distance between the retaining rods which are to engage the inner face of the bow riser so that the those retaining rods are spaced just inboard of the connection of the bow limbs to the bow riser.

It is accordingly an object of the invention to provide an improved bow press which allows easy adjustment of the bow press to accommodate the length of bow riser of a bow to be pressed while the user suspends the bow below the lateral rids extending from the pivot arm brackets of the bow press.

Further objects of the invention are: to provide a bow press which allows a continuous variety of spacings between the pivot arm brackets, to provide an improved bow press which allows the bow string to be deflected and retained forward of the plane of the bow riser and limbs, to provide an improved bow press which provides a terminal to which to attach a cable end detached from the cam or pulley of the bow, to provide an easy to use bow press which allows operation of the bow press by a lone user without assistance from a helper.

These and other objects of the invention will be understood from the detailed description of the invention which follows.

BRIEF DESCRIPTION OF THE DRAWINGS ACCORDING TO THE PRESENT INVENTION

DETAILED DESCRIPTION

Figure 1:
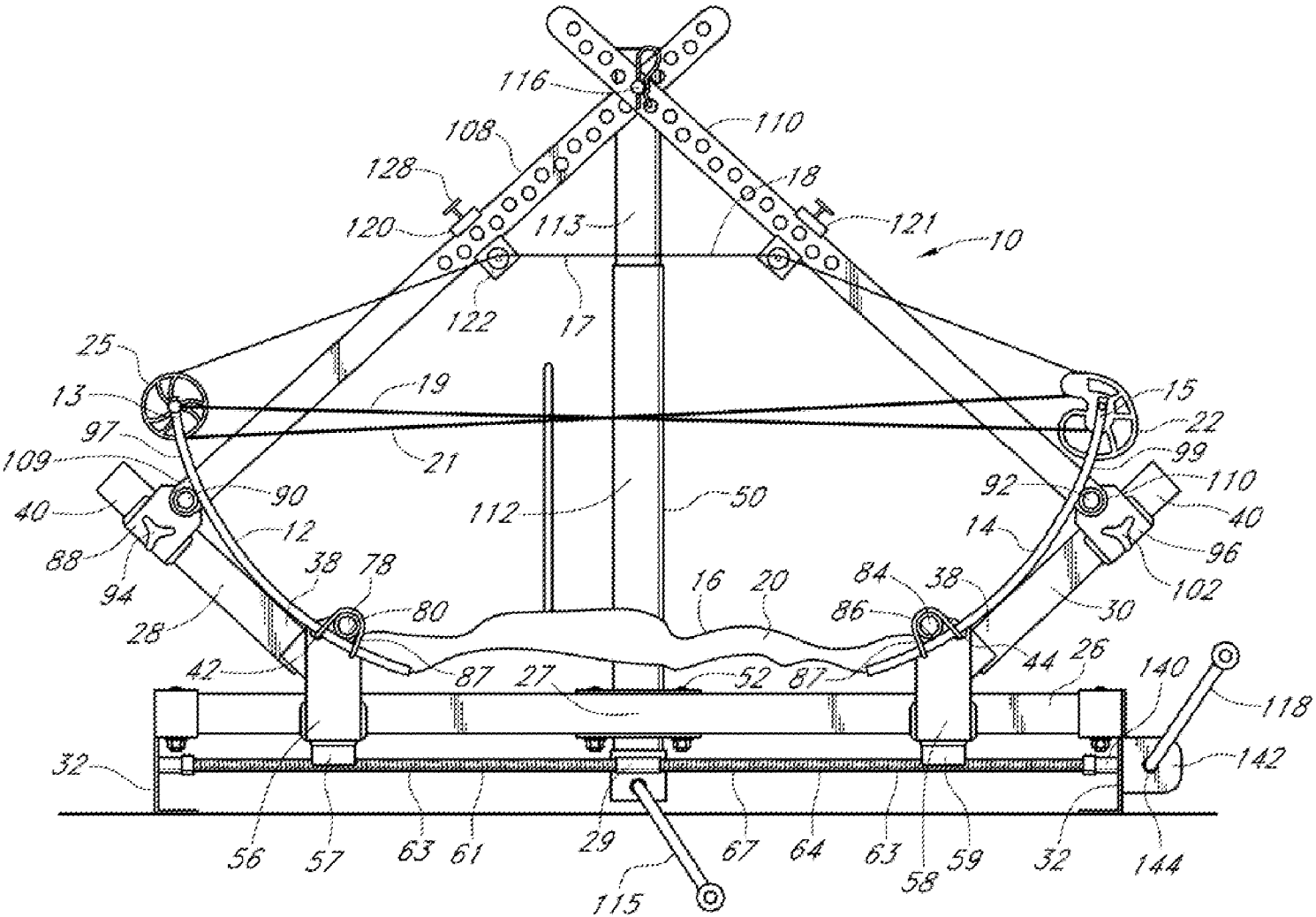
FIG. 1 is a front elevation of the archery bow press with a compound bow installed on the bow press.
Figure 2:
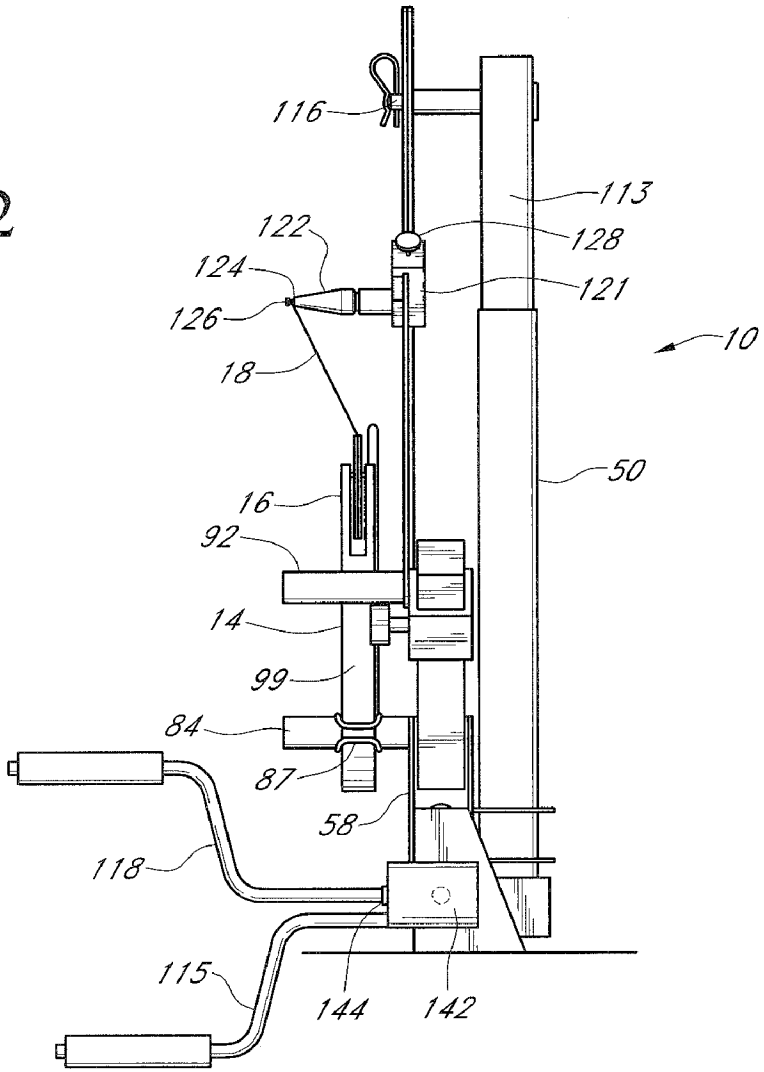
FIG. 2 is a side plan view of the archery bow press of FIG. 1.
Figure 3:
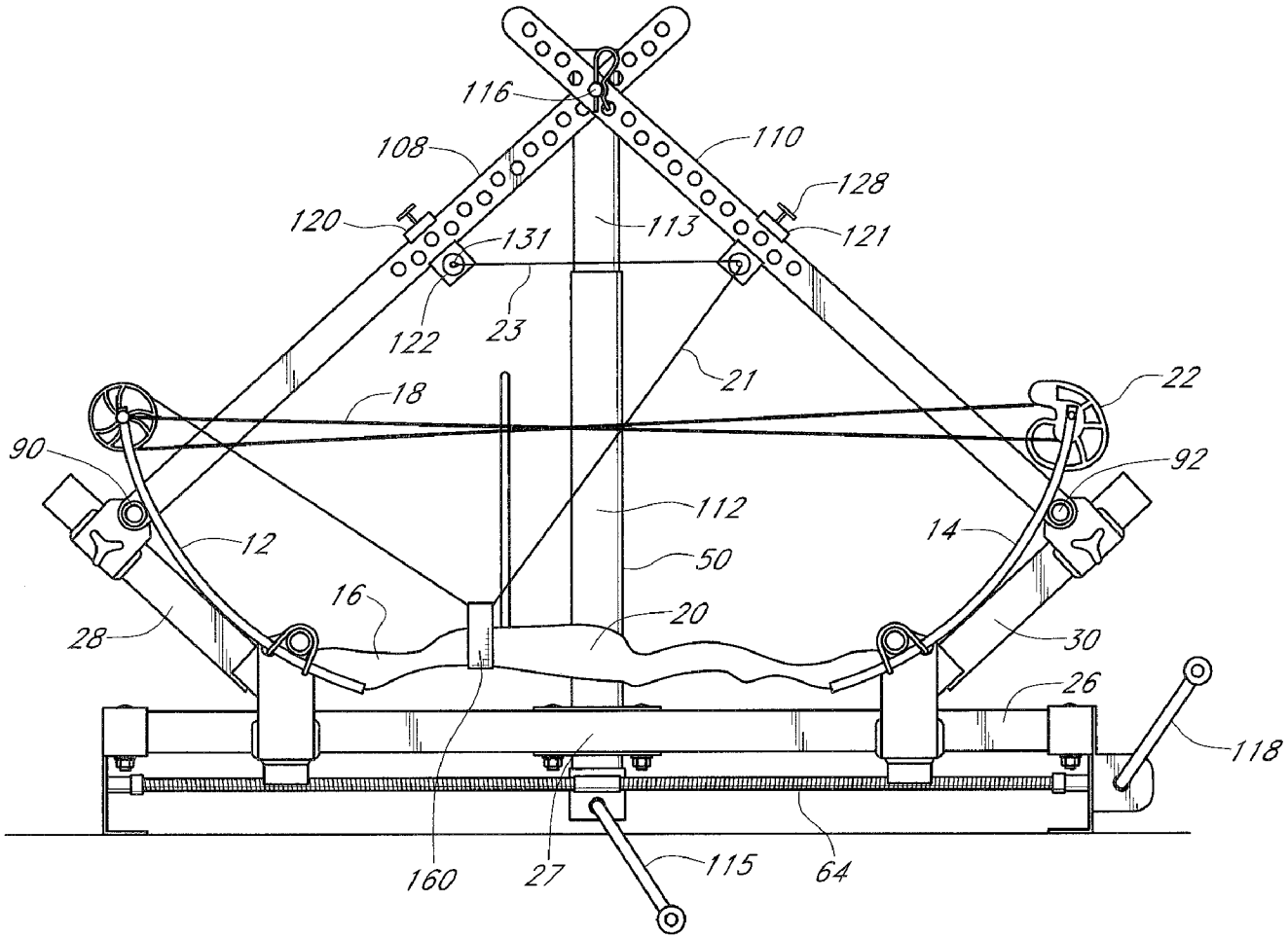
FIG. 3 is a front elevation of the archery bow press of FIG. 1 with a compound bow installed thereon and with one end of the bow string cable disconnected from one limb of the bow and secured to an element of the bow press

FIGS. 1-3 illustrate an exemplary embodiment of an archery bow press 10 according to the invention for deflecting the limbs 12, 14 of an archery bow 16 relative to the riser 20 thereof, to allow installation, replacement, repair or adjustment of a bow string 18 of the bow 16. The bow 16 includes a riser 20 from which limbs 12, 14 extend from opposing ends thereof. The bow 16 includes a pulley 25 at the distal end of limb 12 and a cam 22 at the distal end 15 of the limb 14.

Bow press 10 includes an elongate main beam 26, first and second pivot arms 28, 30, and pivot arm brackets 56, 58 which retain the first and second pivot arms 28, 30 to the main beam 26. First and second pivot arms 28, 30 are adapted for urging the limbs 12, 14 toward each other to relieve tension on the bow string 18.

The first and second pivot arms 28, 30 are spaced from one another along the main beam 26, with each of the first and second pivot arms 28, 30 having a hinged end 38 and a distal end 40. The pivot arm brackets 56, 58 are slidingly retained to the main beam 26.

The hinged end 38 of each pivot arm 28, 30 is attached by pivot arm bracket 56, 58 to the main beam 26, for pivoting motion about pivot axles 42, 44 which retain pivot arms 28, 30 to pivot arm bracket 56, 58, such that pivot arms 28, 30 move in a common plane with main beam 26.

An upstanding screw jack 50 is mounted to main beam 26 by mounting assembly 52 and extends upward perpendicularly from the main beam 26 at its midpoint 27.

An adjustment rod 64 is interconnected with each pivot arm bracket 56, 58 by screw followers 57, 59 such that simultaneous selective sliding movement of the first and second pivot arm brackets 28, 30 may be effected along the main beam 26, toward or away from the midpoint 27 of beam 26.

The adjustment rod 64 is retained to the main beam 26 by central bracket 29 which allows adjustment rod 64 to turn freely. Adjustment rod 64 is provided with screw threads therealong with the pitch of the threads 61 of the left end 63 reversed to the pitch of the threads of the right end 65, that is threads 61 may be right hand threads and threads 67 may be left hand threads, or vice versa. Adjustment rod 64 is operatively connected to the first and second pivot arm brackets 56, 58 such that both pivot arm brackets 56, 58 move at the same rates of travel along the main beam 26 though in opposing directions.

The exemplary embodiment of the bow press 10 includes a first inside surface support 78, adapted for contacting an inside surface 80 the first limb 12 near its connection to the riser 20. The invention allows the first inside surface support 78 to be placed as close as possible to the connection of the first limb 12 to the riser 20, so that the bow 16 can bend in the bow press 10 about the interconnection of the first limb 12 and the riser 20. Similarly second inside surface support 84 contacts inside surface 86 of limb 14 near its connection to riser 20. Preferably inside surface supports 78, 84 are cushioned cylindrical rods. Elastic bands 87 selectively are applied to bow 16 to retain bow 16 to inside surface supports 78, 84.

The first inside surface support 78 is attached to the first pivot arm bracket 56 so that its axis is at a short fixed distance inboard of the first pivot axle 42, with respect to the midpoint 27 of beam 26. This closely adjacent but slightly inboard positioning of the first inside surface support 78 with respect to the pivot axle 42 of the first pivot arm 28, together with having both the first inside surface support 78 and first pivot axle 42 located at a fixed distance from one another on the first pivot arm support bracket 56, provides an advantageous arrangement for properly supporting the inside surface 80 of the bow 16 in a manner that allows the first limb 12 to flex during use of the bow press 10 in a manner that is very similar to the way the first limb 12 flexes when the bow 16 is in normal use.

The second inside surface support 84 is attached to the second pivot arm bracket 58 so that the axis of second inside surface support 84 is a short fixed distance inboard of the second pivot axle 44, with respect to the midpoint 27 of beam 26. This closely adjacent but slightly inboard positioning of the second inside surface support 84, with respect to the pivot axle 44 of the second pivot arm 30, together with having both the second inside surface support 84 and second pivot axle 44 located at a fixed distance from one another on the second pivot arm bracket 58, provides an advantageous arrangement for properly supporting the inside surface 86 of the limb 14 in a manner that allows the second limb 14 to flex during use of the bow press 10.

The bow press 10 further includes a first limb deflector bracket 88 slidingly attached to the first pivot arm 28, with a first limb engaging arm 90 extending laterally from the first limb deflector bracket 88. The first limb engaging arm 90 is adapted for contacting an outside surface 97 of the first limb 12 at a point along the first limb 12 displaced from its connection to riser 20. The first limb deflector bracket 88 includes a locking mechanism 94 for locking the first limb deflector bracket 88 to the first pivot arm 28 at a selected location with respect to the first pivot axle 42. Limb engaging arms 90, 92 are relatively short but preferably extend perpendicularly from each of pivot arms 28, 30.

In similar fashion, a second limb deflector bracket 96 is slidingly attached to the second pivot arm 30 and includes a second limb engaging arm 92 extending laterally and perpendicularly from the second limb support bracket 96, with the second limb engaging arm 92 contacting an outside surface 99 of the second limb 14 at a point along the second limb 14 spaced away from riser 20. The second limb deflector bracket 96 includes a locking device 102 such as a locking screw which selectively locks the second limb deflector bracket 96 against movement along the second pivot arm 30 at a selected location with respect to the second pivot axle 44.

The bow press 10 further includes a screw jack 50 substantially centered On beam 26, as well as a first link 108 and a second link 110. The screw jack 50 has a stationary base section 112 attached to the main beam 26 of the bow press 10 by jack mounting brackets 52. The screw jack 50 further includes an extensible section 113 telescoping from base section 112 of the screw jack 50. The screw jack 50 is attached to the main beam 26 at its midpoint 27 in such a manner that when first screw crank 115 is turned, the extensible section 113 of the screw jack 50 extends or retracts from base section 112.

The first and second links 108, 110 each have a first end 109, 111 pivotably attached respectively to the first and second limb engaging arms 90, 92, so that each pivots freely with respect to pivot arms 28, 30. The first and second links 108, 110 cross and are each removably joined to the other by a pin 116 mounted to and extending perpendicularly from the extensible section 113 of the screw jack 50.

The first and second links 108, 110 have equal lengths between their respective first ends 109, 111, and the common connection provided by the pin 116. The screw jack 50 functions to raise and lower both pivot arms 28, 30 together thereby exerting lifting force to limb engaging arms 90, 92 and hence applying bending force to the limbs 12, 14 of bow 16 mounted in the bow press 10.

Each of first and second links 108, 110 includes a pin support bracket 120, 121 which may be selectively slideable along the respective link 108, 110. Adjustment of pin support brackets 120 along links 108, 110 is accomplished by loosening lock screws 128 of each pin support bracket 120, 121. Each pin support bracket 120, 121 includes a protrusion, preferably a cylindrical pin 122, extending horizontally therefrom generally perpendicular to links 108, 110 and extending over bow 16. From FIG. 2 it can be seen that cylindrical pins 122 are preferably tapered and each includes a groove 124 near its free end 126. The grooves 124 are selected to receive the bow string 18 when deflected from its ordinary use position. The length of pins 122 and placement of grooves 124 on each pin 122 are selected such that they preferably lie outside the plane defined by the centerline of the bow riser 20 and the beam 26. Therefore, with the tension on bow string 18 relaxed by flexing of limbs 12, 14, the nock portion 17 of the bow string 18 may be displaced from the cable sections 19, 21 of the bow string 18. Then the extensible section 113 of screw jack 50 may be lowered, returning tension to bow string 18. Replacement of worn or broken serving wrapped around nock portion 17 may be easily accomplished when the nock portion 17 is pulled upward and placed on grooves 124 of pins 122. Pins 122 serve to laterally and vertically separate nock portion 17 from the remainder of bow string 18.

First end 140 of adjustment rod 64 is coupled to a gear box 142 adapted to allow adjustment rod 64 to be rotated from a perpendicular direction. Specifically gear box 142 houses a spider gear which allows a second crank 118 to apply rotational force to crank coupling 144 of gear box 142 with the result that adjustment rod 64 rotates. As adjustment rod 64 rotates, threaded couplers within each of screw followers 57, 59 are driven by opposing threads 61, 67 causing pivot arm brackets 56, 58 to converge or diverge at equal rates. Thus pivot arms 28, 30 are symmetrically adjusted to accommodate the length of a bow 16 to be pressed. Because the bow 16 to be pressed in bow press 10 must be supported by the user as the pivot arms 28, 30 are moved, having a crank coupling 144 facing the holder of the bow 16 eases the chore of adjusting the bow press 10 to fit the bow 16 such that inside surface supports 78, 84 are positioned just outboard of the limb connections of limbs 12, 14 to riser 20. Then elastic straps 87 can be applied to suspend bow 16 from inside surface supports 78, 84.

Importantly, gear box 142 at first end 140 of adjustment rod 64 permits rotation of adjustment rod 64 by a user using second crank 118 to rotate the crank coupler 144 while standing in front of bow press 10 and holding bow 16. This allows the user to easily reposition the pivot arm brackets 56, 58 while suspending the bow 16 with one hand until the separation of pivot arm brackets 56, 58 is appropriate so the bow limbs 12 and 14 are supported properly.

FIG. 3 illustrates the bow press 10 in use to support bow 16 while cam end 131 of cable portion 21 of bow string 18 is repaired. With bow 16 placed onto bow press 10 with extensible section 113 retracted into stationary section 112 of screw jack 50 such that limb engaging arms 90, 92 do not touch limbs 12, 14, and with bow string 18 attached to bow 16 in condition for use, extensible section 113 may be raised thereby flexing limbs 12, 14 toward screw jack 50. Deflection of limbs 12, 14 toward each other relaxes tension on bow string 18 and permits detachment of first cam end 131 of cable portion 21 of bow string 18 from cam 22. Cable portion 21 can then be passed around tapered pin 122 of second pin support bracket 121 and attached to pin 122 of first pin support bracket 120 which is attached to first link 108. A variable length strap 160 may be placed around both cable portion 21 and riser 20 to retain cable portion 21 to riser 20. Thereafter, extensible section 113 of screw jack 50 is lowered, returning tension to bow string 18. By careful attention to the preservation of twist in bow string 18 when it is detached from cam 22 and hooked to pin 122 of first pin support bracket 120, the tuning of bow string 18 can be preserved while repair to serving wound around cable portion 21 is accomplished. Once repair has been completed, such as by replacement of serving around the end section 23 of cable portion 21, extensible section 113 can again be extended thereby pressing limbs 12, 14 toward each other and detensioning bow string 18. This permits easy and safe removal of strap 160 and reattachment of cam end 131 to cam 22 while tuning of bow string 18 is maintained as previously set.

When the bow press 10 is to be used, the position of the inside surface supports 78, 84 and limb engaging arms 90, 92 are adjusted to fit the bow 16. First crank 115 is applied to screw jack 50 to retract the extensible section 113 of the screw jack 50 to an initial position where the bow 16 can be inserted without resistance into the press 10 with the inside surface supports 78, 84 generally on the inside of the bow 16 and closely adjacent the attachments of the first and second limbs 12, 14 to the riser 20. Adjustment of the spacing of pivot arm brackets 56, 58 is accomplished by turning adjustment rod 64 with second crank 118. The limbs 12, 14 will be inboard of the first and second limb engaging arms 90, 92.

The connection point between the first and second links 108, 110 may also be adjusted if necessary by repositioning pin 116 in different holes in links 108, 110 to allow placement of the bow 16 into the bow press 10. Adjacent holes in the links 108, 110 are laterally offset from one another to aid in visually connecting the links 108, 110 to the pin 116 in such a manner that the links 108, 110 have equal lengths between their respective first ends at the first and second limb engaging arms 90, 92, and the common connection provided by the pin 116.

By virtue of the construction of the bow press 10 as described above, the position of the first and second pivot arm brackets 56, 58 along the beam 26 is easily adjustable to thereby allow for very precise and proper positioning of the location of the inside surface supports 78, 84 to match the bow 16. Also, by virtue of the coupling of adjustment rod 64 to pivot arm brackets 56, 58, as either of the first or second pivot arm brackets 56, 58 is moved along the beam 26, the other pivot arm bracket moves an equal distance in the opposite direction along the beam 26, so that the first and second bow supports 78, 84, and the pivot pins 42, 44 are always maintained at symmetrical locations with respect to the upstanding screw jack 50, regardless of where either of the pivot arm brackets 56, 58 is positioned along the beam 26.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

What is claimed is:

1. In a bow press having an elongate beam, a pair of adjustment arms retained to the beam and slidable therealong, the adjustment arms pivotable upon the beam, each adjustment arm having an elongate link member hinged thereto, the elongate link members each being selectively joined to an extensible section of a jack, the improvement comprising at least one bracket is disposed along at least one of the elongate link members, the at least one bracket supporting a pin element extending generally horizontally from the at least one of the elongate link members, the pin element including a bow string receiving element therealong the bow string receiving element is a groove adjacent a free end of the pin element.

2. The improvement of claim 1 wherein the groove receiving a length of a bow string of a bow supported on the bow press.

3. The improvement of claim 1 wherein the at least one bracket is selectively positionable along the elongate link.

4. The improvement of claim 1 wherein a second bracket is disposed along the other of the elongate links, the second bracket includes a pin element extending generally substantially horizontally therefrom.

5. The improvement of claim 1 wherein each adjustment arm is coupled to a threaded rod, the adjustment arms moveable in opposing directions along the beam responsive to rotation of the threaded rod.

6. The improvement of claim 1 wherein the pin element includes a substantially conical portion, the groove is on the substantially conical portion, the groove receiving a length of a bow string of a bow supported on the bow press.

7. Apparatus to selectively deflect limbs of an archery bow relative to a riser thereof, the invention comprising an elongate generally horizontal beam, first and second brackets slidably retained to the beam, a threaded rod disposed generally parallel to the beam, the first and second brackets slidable along the beam at substantially equal rates in opposing directions as the threaded rod is rotated, a first pivot arm hinged to the first bracket, a second pivot arm hinged to the second bracket, a first limb support bracket retained to the first pivot arm and selectively slidable therealong, a second limb support bracket retained to the second pivot arm and selectively slidable therealong, an arm extending laterally from each of the first and second limb support brackets, a first elongate link hinged to the first limb support bracket, a second elongate link hinged to the second limb support bracket, at least one elongate link has a bow string receiving element and the bow string receiving element is an annular groove, an upstanding jack disposed at substantially a midpoint of the horizontal beam, the jack having a selectively extensible member, each of the first and second links selectively retained to the extensible member.

8. The apparatus of claim 7 wherein at least one elongate link has a selectively positionable pin supported therealong, the pin extending laterally from the at least one elongate link, the pin including the annular groove adjacent a free end thereof.

9. The apparatus of claim 7 wherein each of the elongate links includes a pin support member selectively slidable therealong, a pin extending laterally from each of the pin support members, each pin including a free end, the annular groove adjacent to the free end of each pin.

10. The apparatus of claim 7 wherein each of the first and second brackets is coupled to the threaded rod, each of the first and second brackets sliding along the beam in response to rotation of the threaded rod.

11. The apparatus of claim 10 wherein the threaded rod extends substantially the entire length of the beam, each of the first and second brackets coupled to the threaded rod by screw followers, the threaded rod having right hand screw threads along a first portion thereof and left hand screw threads along a second portion thereof.

12. The apparatus of claim 10 wherein a drive member is drivingly coupled to the threaded rod, the drive member having an axis generally perpendicular to a longitudinal axis of the threaded rod.

13. The apparatus of claim 12 wherein a gear box is drivingly coupled to an end of the threaded rod, the drive member being selectively coupled to a coupler on the gear box, the gear box housing a spider gear, the spider gear coupling the coupler on the gear box to the threaded rod, the threaded rod retained below the beam by a central bracket depending from the beam.

14. The apparatus of claim 13 wherein the threaded rod extends substantially the entire length of the beam, each of the first and second brackets coupled to the threaded rod by screw followers.

15. The apparatus of claim 10 wherein a gear box is drivingly coupled to an end of the threaded rod, a drive member being selectively coupled to a coupler on the gear box, the drive member having an axis of rotation, the axis of rotation of the drive member non-coaxial with a longitudinal axis of the threaded rod when the drive member is coupled to the coupler on the gear box.

16. The apparatus of claim 7 wherein a crank member is operatively coupled to the threaded rod, the crank member having an axis substantially perpendicular to an axis of the threaded rod, the crank member coupled to the threaded rod through a gear box, the gear box housing a spider gear, the spider gear coupling the crank member to the threaded rod, the threaded rod having a first end with right hand threads thereon, the right hand threads coupled to a first of the first and second brackets by a first screw follower, the threaded rod having a second end with left hands threads thereon, the left hand threads coupled to a second of the first and second brackets by a second screw follower, the threaded rod supported by a central bracket depending from the beam, the threaded rod extending substantially the entire length of the beam.

17. The apparatus of claim 7 wherein an inside surface support member is supported on each of the first and second brackets, each inside surface support member extending substantially horizontally from the bracket on which it is supported, at least one elastic band connected to each of the inside surface support members, the at least one elastic band of each of the inside surface support members retaining the archery bow to the inside surface support member.

18. The apparatus of claim 17 wherein at least one elongate link has a selectively positionable tapered pin supported therealong, the pin extending laterally from the at least one of the first and second elongate links, the pin being tapered to a free end thereof, the pin including the bow string receiving groove adjacent the free end thereof.

19. The apparatus of claim 18 wherein the bow string receiving groove is located along the pin such that a nock portion of a bow string of the bow received in the groove is displaced laterally from cable sections of the bow string.

20. The apparatus of claim 7 wherein the threaded rod disposed proximate to and below the beam, the threaded rod retained below the beam by a central support bracket depending from the beam, the threaded rod including a first end section having right hand threads and a second end section having left hand threads, the first bracket operatively coupled to the right hand threads of the threaded rod, the second bracket operatively coupled to the left hand threads of the threaded rod, a gear box coupled to an end of the threaded rod, a drive member operatively coupled to the gear box, the drive member having an axis of rotation substantially perpendicular to a longitudinal axis of the threaded rod, the gear box including an exterior coupling, the drive member coupled to the exterior coupling, the gear box housing a spider gear therein, the spider gear coupling the exterior coupling to the threaded rod.

21. The apparatus of claim 20 wherein each of the elongate links includes a pin support member selectively slidable therealong, a substantially conical pin extending laterally from each of the pin support members, each pin including a free end, the annular groove is on each pin adjacent the free end thereof.

* * * * *